US006098246A

United States Patent [19]

Moir

[11] Patent Number: 6,098,246

[45] Date of Patent: Aug. 8, 2000

[54] ADAPTER FOR CONVERSION OF VERTICAL BLINDS TO CURTAINS

[76] Inventor: Alan R. Moir, 178 Uplands Drive, Kitchener, Ontario, Canada, N2M 4X6

[21] Appl. No.: 09/206,941

[22] Filed: Dec. 8, 1998

[51] Int. Cl.[7] ..... E05D 15/00

[52] U.S. Cl. ..... 16/87.2; 160/345

[58] Field of Search ..... 16/87.2, 93 D, 16/94 D, 96 D, 97, 106; 160/345, 330; 24/116 A, 115 G

[56] References Cited

U.S. PATENT DOCUMENTS

| | | | |
|---|---|---|---|
| 2,302,341 | 11/1942 | Nash | 16/87.2 |
| 2,703,429 | 3/1955 | Sarkisian | 16/87.2 |
| 3,137,027 | 6/1964 | Birkle | 16/87.2 |
| 4,675,939 | 6/1987 | Fukada | 16/87.2 |
| 4,964,191 | 10/1990 | Wyatt | 16/87.2 |
| 5,282,292 | 2/1994 | Levy | 16/87.2 |
| 5,291,632 | 3/1994 | Akashi | 16/87.2 |
| 5,379,496 | 1/1995 | Krauss | 24/625 |

*Primary Examiner*—Chuck Y. Mah
*Attorney, Agent, or Firm*—R. Craig Armstrong

[57] ABSTRACT

This invention relates to a glide which permits curtains to be hung from conventional vertical blind systems, such as those using carriers movable along horizontal blind tracks. In the invention, a glide designed to secure a curtain to a carrier is provided, the glide having a body portion and an elongated upwardly extending piece. The upwardly extending piece is inserted and locked into a downward opening aperture in each carrier. The body portion of the glide extends downwardly from the carrier and has an opening, the female portion of a snap fastener assembly. The male portions of snap fasteners are secured along the upper edge of a curtain or are attached to the curtain using snap tape. When the male and female snap fastener assembly pieces are secured together, the curtain is functional and operable with the vertical blind track unit.

8 Claims, 5 Drawing Sheets

ADAPTER FOR CONVERSION OF VERTICAL BLINDS TO CURTAINS

BACKGROUND OF THE INVENTION

1. Field of the Invention

This invention relates to coverings for windows and doors or the like, and in particular to a glide which permits curtains to be hung from conventional vertical blind hardware.

2. Description of the Prior Art

In conventional vertical blinds, each vertical strip or vane is clipped at the top by a glide, to hang from the glide. Glides snap into one of a number of carriers, which run along a downwardly-opening generally U-shaped track, usually placed atop a window so that the blinds can hang down over the window. The carriers are slidable along the length of the track, secured within the length of the track. The carriers are linked together along the track by spacer link pieces of equal length. These spacer link pieces are designed to slide out and extend evenly along the entire track. An end spacer link piece is attached to one end of the track unit. Spacer link pieces are slidably connected to one another, so that the spacer link pieces can move from a bunched up position to a spread out position. In the bunched up position, the spacer link pieces overlap each other. In the spread out position, they extend evenly over the entire track. Each carrier is positioned on one spacer link piece, and is free to slide along each spacer link piece, but is prevented from moving off each piece by a stopper at each end. Because the spacer link pieces are of equal length, the carriers become evenly spaced along the track when the spacer link pieces are fully spread out along the track. The spacer link pieces and the attached carriers are movable from the bunched up position to the spread out position by means of a cord or by means of a wand which is attached to the end carrier, which is itself is attached to the end spacer link piece. In the cord system, the cord runs the entire length of the track and is operable by a pulley system at one end of the track, allowing the carriers to be moved from the bunched up position (leaving the window exposed) to the spread out position (covering the window). Because the carriers are evenly spaced along the track, the blinds hang adjacent to each other, uniformly spaced across the entire length of the track.

Each glide has a body portion and an elongated upwardly extending piece. The upwardly extending piece is inserted and locked into the downward opening in each carrier. The body portion of the glide extends downwardly from the carrier and has a clip mechanism into which the vertical vanes can be clipped into and hung.

The use of curtains as window decoration and/or as window shading is often preferred over vertical blinds for both aesthetic and functional reasons. Aesthetically, curtains are often preferred over vertical blinds because they may be more appropriate for the decor of a room given colour, texture, length and overall appearance. An important part of the aesthetic appeal created by curtains is the pleating of the curtain along its top edge. Pleats are created when the curtain material is bunched together. Preferably, when the curtain is drawn, evenly spaced pleats are formed along the top edge of the curtains. These evenly spaced pleats create a neat visual appearance to the curtain. Utilizing vertical blind units to hang curtains would be a significant improvement in the use of curtains because they would ensure even pleating of the curtain since the carriers are evenly spaced along the blind track.

Functionally, curtains are often preferred oververtical blinds because they can block the transmission of light through a window more effectively than vertical blinds due to the inevitable gaps which occur between the vertical strips of vertical blinds. Also, when wind acts upon vertical blinds, they tend to cause considerably more noise and movement than wind acting on curtains.

A disadvantage to the use of curtains is that they are not as conveniently opened and closed as vertical blinds using the above disclosed track units. Curtains are typically opened and closed by securing a rod or cord to the end of the curtain which is used to pull open or close the curtain. Often, this causes the curtains to bunch unevenly. As such, it is the object of the invention to make curtains adaptable for use with vertical blind track units. Presently, vertical blind track units are not adaptable to hold curtains because the glides which clip vertical blind strips and attach to the carriers in vertical blind units are not adaptable to hold curtains. The present invention improves on the prior art by creating a fastener which allows the attachment of curtains to vertical blind track carriers so that curtains can be utilized on vertical blind track systems.

SUMMARY OF THE INVENTION

It is an object of the invention to provide a glide which permits curtains to be hung from the carriers normally used for vertical blinds. As disclosed in the prior art, the carriers are movable on a vertical blind track and are designed to remain evenly spaced along the track, through the use of spacer link pieces which are extendable along the track. Each carrier has a downwardly opening aperture shaped to receive a glide.

In the invention, a glide is provided, having a body portion and an elongated upwardly extending piece, having a depressable catch tongue which when inserted into the downward opening aperture of the carrier, depresses and catches, thus locking the glide into the carrier aperture. The body portion of the glide extends downwardly from the carrier and has an opening, preferably circular, constituting the female portion of a male-female snap fastener assembly, configured to receive the male portion of a snap fastener assembly. Once inserted into each carrier, each glide is fixed in place and cannot rotate on its vertical axis. If desired, the glide can be removed from the carrier and replaced.

Preferably, male portions of conventional snap fasteners, are secured through the upper edge of a curtain, evenly spaced along the length of the upper edge. The preferred distance between the fasteners must be more than the distance between each carrier when they are maximally spread out along the blind track. In order to ensure that the fasteners do not tear out of the curtain, a strip of supporting material can be hemmed along the upper edge of the curtain. The fasteners are inserted through this material so as to ensure that they do not tear out of the curtain material, once the curtain is hung. Snap fastener tape can also be used to secure the fasteners to the curtain. Snap fastener tape has the male portion of the snap fasteners, attached along a piece of tape material, which itself can be attached to the curtain. The distance between each fastener could be the standard distance of 4¼ inches or the snap tape could be custom manufactured to vary the distance between the male portions of the fasteners, thus adjusting the fullness of the drapes. The farther the fasteners are to each other along the drape, the greater the perceived fullness of the drapes.

Snap fasteners are preferred to clip fasteners because the snap fasteners are better able to secure the curtains than the clips. When snapped together, the male and female portions of the snap fasteners create a strong connection but they can be separated by pulling the pieces apart. Thus, the snap fasteners allow the curtains to be removed and then reconnected to the track systems, for washing or for curtain replacement. Also, in traditional curtain systems, inadvertent pulling on the curtain may cause the curtain to tear. When the curtain is inadvertently pulled in a system using snap fasteners, the snaps will release before the curtain tears.

Further features of the invention will be described or will become apparent in the course of the following detailed description.

BRIEF DESCRIPTION OF THE DRAWINGS

The invention will now be described in detail with reference to the accompanying drawings of the preferred embodiment by way of example. In these drawings.

DETAILED DESCRIPTION OF THE PREFERRED EMBODIMENT

Figure 1:
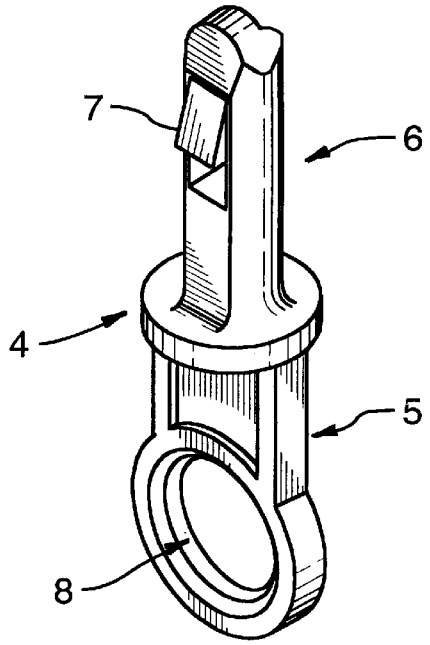
FIG. 1 is perspective view of the preferred embodiment of the glide.
Figure 2:
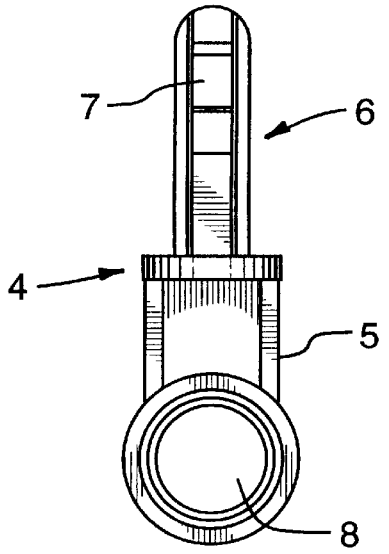
FIG. 2 is a side view of the preferred embodiment of the glide.
Figure 3:
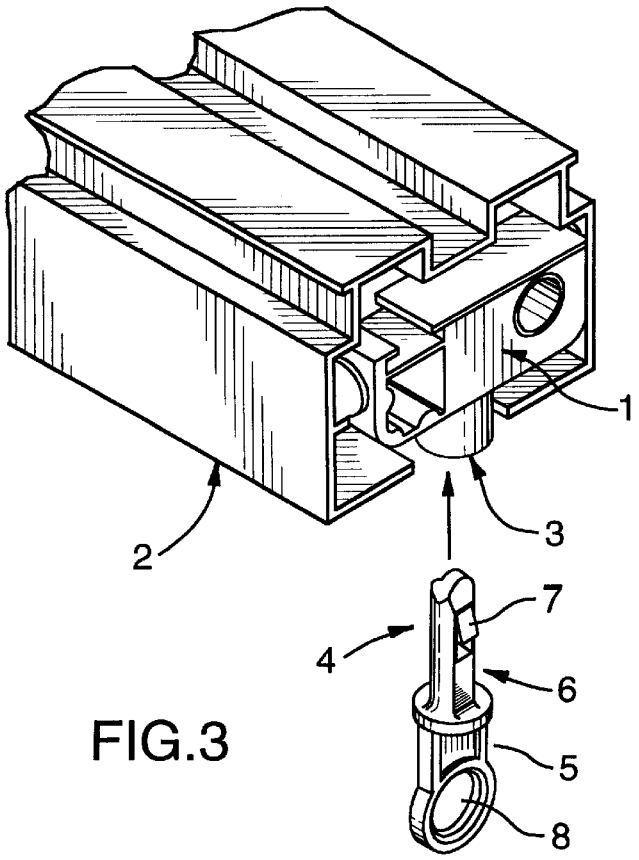
FIG. 3 is a perspective view of a curtain system showing the carrier and glide unattached.
Figure 4:
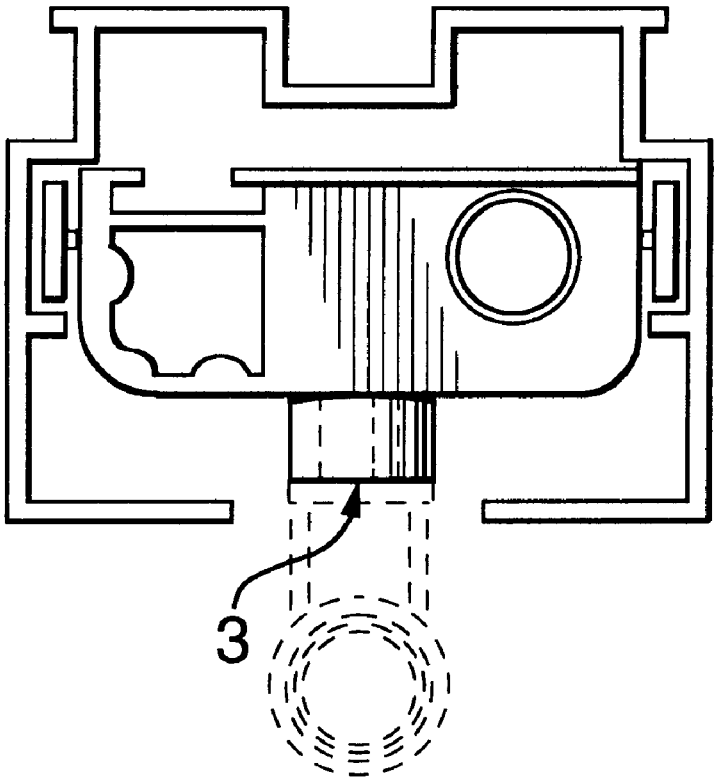
FIG. 4 is a side view of the carrier and glide being attached.
Figure 4:
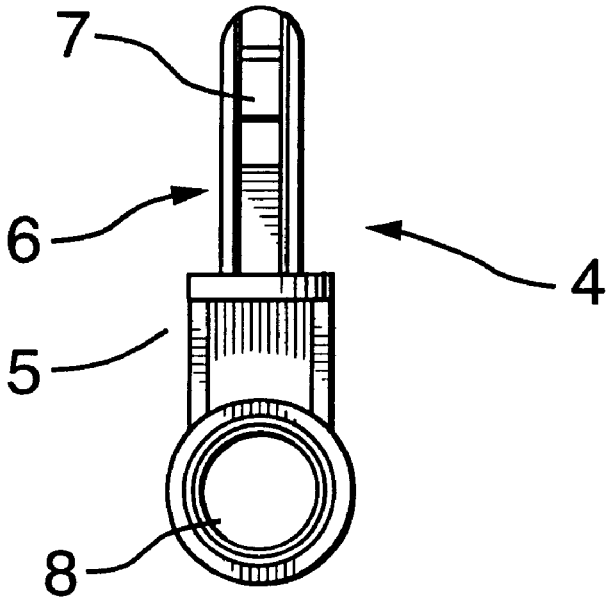
Figure 5:
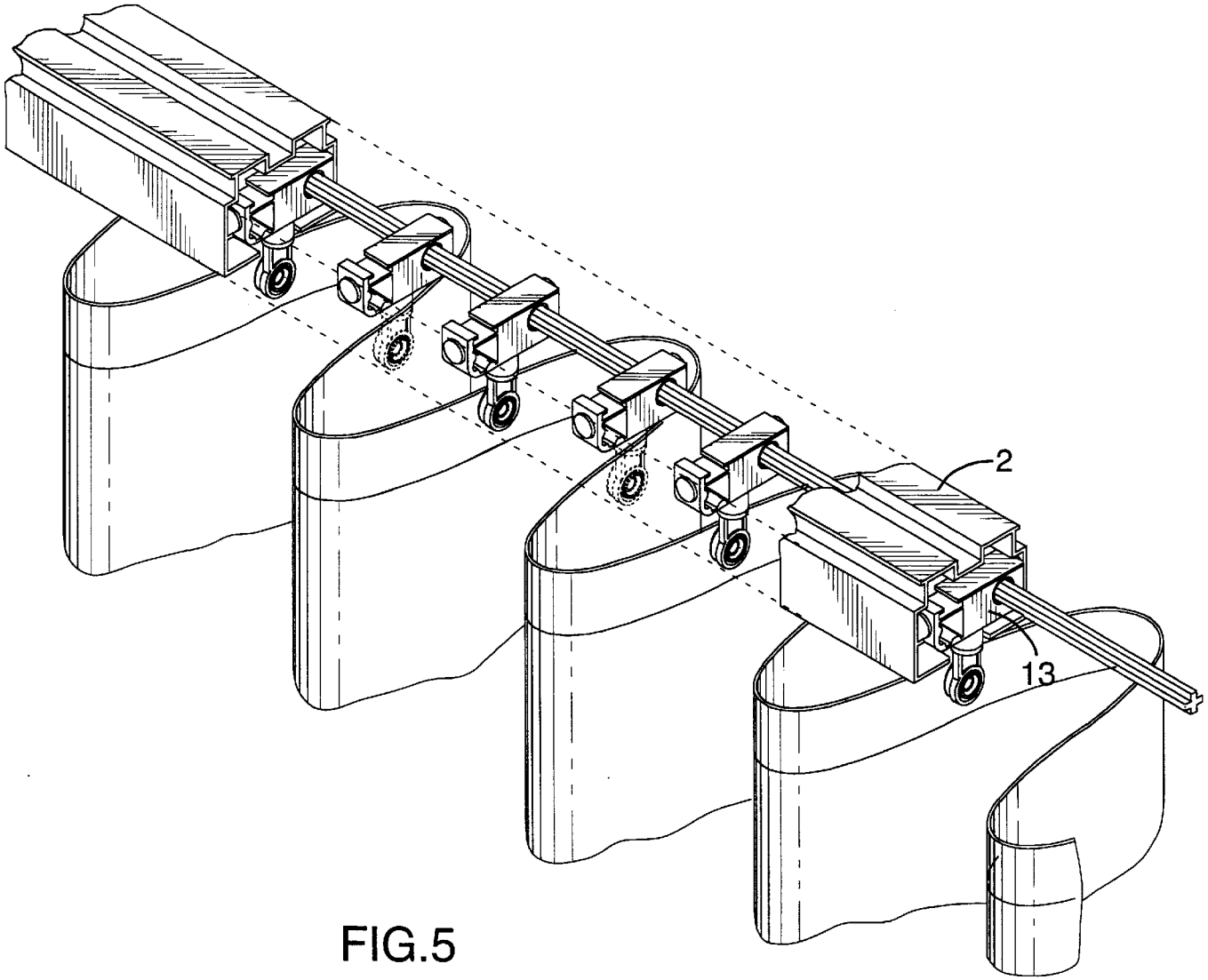
FIG. 5 is perspective view of a converted blind track unit.
Figure 6:
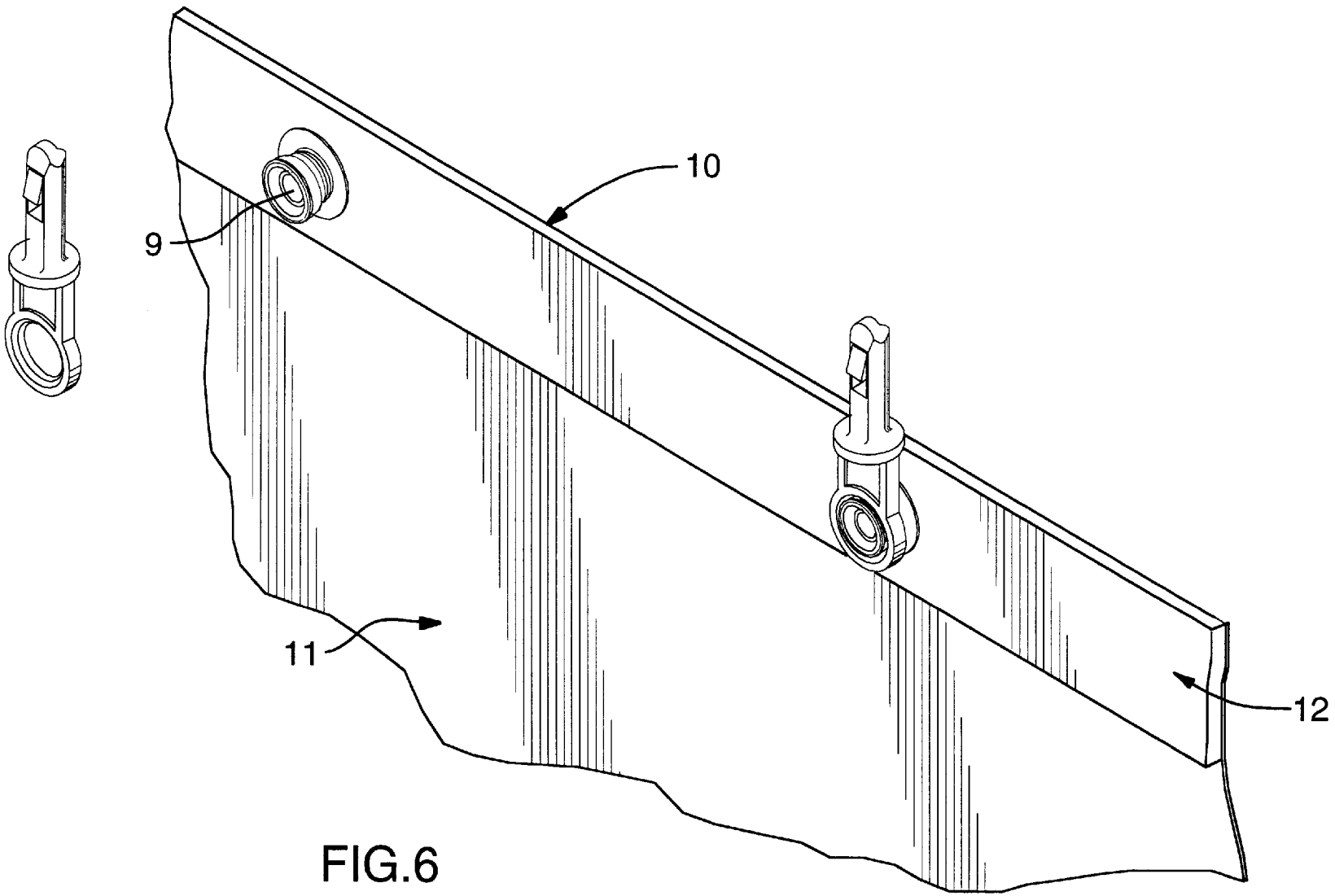
FIG. 6 is an exploded perspective view of a glide attached to a curtain.
Figure 7:
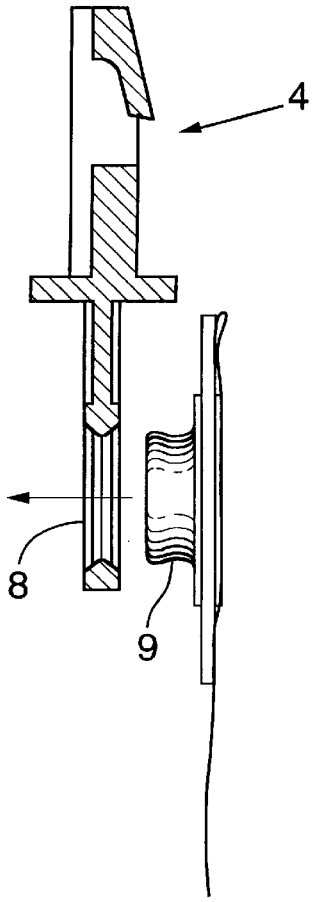
FIG. 7 is a side view of a glide and curtain, unattached.
Figure 8:
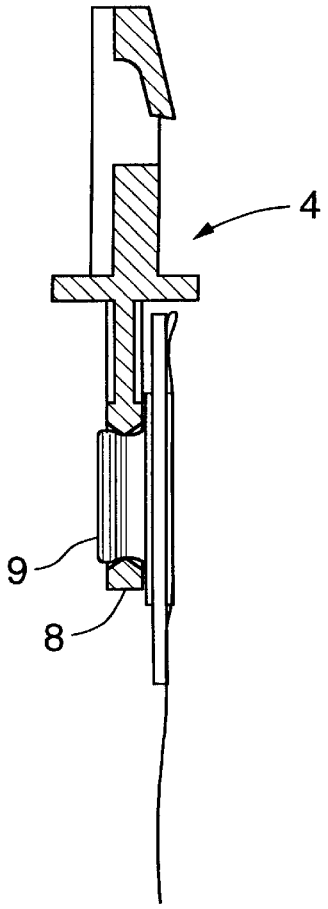
FIG. 8 is a side view of a glide and curtain showing the male and female portions of the snap fasteners attached.

In the preferred embodiment of the invention, as shown in FIGS. 1–8, carriers 1 are movable on a vertical blind track 2 and are designed to be evenly spaced along the track when spread out along the length of the track. The blind track is generally U-shaped and downwardly opening. Carriers are placed within the track and are free to move along the length of the track. Each carrier has a downwardly opening aperture 3 shaped to receive a glide 4. A glide 4 is provided, having a body portion 5 and an upwardly extending piece 6 including a depressable catch tongue 7. The downwardly opening aperture 3 has a first narrow cavity portion at the entrance of the aperture and a second cavity portion which has a larger interior area than the first narrow cavity. When the upwardly extending piece 6 is inserted into the downwardly opening aperture 3, the depressable catch tongue piece depresses against the interior surface of the first narrow cavity portion. As the upwardly extending piece enters the second cavity portion, the catch tongue piece returns from its depressed position and catches against the upper side of the first narrow cavity portion thus locking the glide into the carrier aperture 3. Once inserted into each carrier, each glide is fixed in place and cannot rotate on its vertical axis. Although the glide is fixed in place, it can be removed from the carrier aperture and replaced.

The body portion of the glide extends downwardly from the carrier and has an opening 8 (the female portion of a male female snap fastener assembly), preferably circular, configured to receive the male portion 9 of a conventional snap fastener. Preferably, the angle of this opening in relation to the blind track is the same for each carrier in order to ensure that the curtains hang evenly.

In the preferred embodiment, male portions of conventional snap fasteners 9, are placed along the upper edge 10 of a curtain 11, evenly spaced along the length of the upper edge. The preferred distance between the fasteners should be more than the distance between each carrier when they are maximally spread out along the track. The male portion of the snap fastener is provided by a snap tape product 12 which has male portions of the snap fastener attached to it, spaced at regular intervals along its length. The snap tape product is then secured to the upper edge of the curtain 12. Use of this snap tape product allows curtains to be easily adapted to vertical blind hardware by simply securing the snap tape to the upper edge of a curtain. Alternately, the fasteners can be attached to the curtain directly. In order to ensure that the fasteners do not tear out of the curtain, a strip of additional supporting material can be hemmed along the upper edge of the curtain.

To hang the curtain, each end of the curtain is aligned to each end carrier 13, and the male portions of the snap fasteners in the curtain are snapped into the opening on each glide (the female portion of the snap fastener), thus fixing the snap fasteners in place. The curtain can be opened or closed by operating a pulley or wand system, which moves the carriers along the blind track, as described in the prior art.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, the snap fastener assembly could be any suitable shape, not necessarily circular. Additionally, the upper extending piece of the glide could contain any type of securing means to the carrier, namely an hook and latch mechanism or some form or use of adhesive. The lower body portion of the glide could be any shape. Also, the curtain could contain any type of reinforcement to ensure that the male piece of the snap fastener assembly units do not tear out of the curtain.

What is claimed is:

1. A curtain system, comprising:

a track;

a plurality of carriers slidably mounted for movement along said track;

a plurality of glides, namely one per carrier, detachably securable to each carrier so as to extend downwardly therefrom, each said glide including a female portion to receive a male portion of a male-female snap fastener assembly, an upwardly extending piece; said upwardly extending piece including a depressable catch tongue piece extruding from its side; and a lower body portion including said female portion; each said carrier including a downwardly opening aperture shaped to receive said upwardly extending piece of said glide; and a curtain, said curtain including a plurality of said male portions of male-female snap fastener assemblies secured thereto, evenly spaced longitudinally, and adjacent an upper edge of said curtain; said male portions being detachably securable to said female portions.

2. A curtain system as recited in claim 1 where said upwardly extending piece is fixed in place once inserted into said downwardly opening aperture of said carrier.

3. A curtain system as recited in claim 1 where said male and female portions of the snap fastener assembly are circular.

4. A curtain system as recited in claim 1 where said curtain comprises a strip of additional supporting material hemmed to said curtain adjacent to the upper edge of said curtain, said male portions secured to said curtain and said additional supporting material.

5. A curtain system as recited in claim 1, where the angle of said female portion opening in relation to the length of the track is equal for each glide on the curtain system once each said glide is attached to each said carrier.

6. A curtain system, comprising:

a track;

a plurality of carriers slidably mounted for movement along said track;

a plurality of glides, namely one per carrier, detachably securable to each carrier so as to extend downwardly therefrom, each said glide including a female portion to receive a male portion of a male-female snap fastener assembly; an upwardly extending piece; said upwardly extending piece including a depressable catch tongue piece extruding from its side; and a lower body portion including said female portion; each said carrier including a downwardly opening aperture shaped to receive said upwardly extending piece of said glide;

a portion of snap tape material including a plurality of said male portions of male-female snap fastener assemblies secured thereto; said male portions being detachably securable to said female portions; and a curtain;

said snap tape material being secured to said curtain, adjacent to the upper edge of said curtain, extending the entire length of said upper edge, said male portions evenly spaced along said snap tape and thus the upper edge of said curtain, once said snap tape is secured thereto.

7. A curtain system as recited in claim 6 where said upwardly extending piece is fixed in place once inserted into said downwardly opening aperture of said carrier.

8. A curtain system as recited in claim 6 where said male and female portions of the snap fastener assembly are circular.

* * * * *